United States Patent [19]

McCormick

[11] Patent Number: 4,900,281

[45] Date of Patent: Feb. 13, 1990

[54] MARINE DRIVE WITH IMPROVED PROPELLER MOUNTING

[75] Inventor: Daniel F. McCormick, Oshkosh, Wis.

[73] Assignee: Brunswick Corporation, Skokie, Ill.

[21] Appl. No.: 197,620

[22] Filed: May 23, 1988

[51] Int. Cl.[4] ..... B63H 1/14

[52] U.S. Cl. ..... 440/78; 440/49

[58] Field of Search ..... 440/49, 75, 81, 78, 440/900

[56] References Cited

U.S. PATENT DOCUMENTS

| | | | |
|---|---|---|---|
| 3,888,203 | 6/1975 | Lohse | 440/75 |
| 4,317,655 | 3/1982 | Schiek | 440/78 |
| 4,604,208 | 8/1986 | Guinn | 440/78 |
| 4,798,548 | 1/1989 | Higby et al. | 440/78 |
| 4,832,635 | 5/1989 | McCormick | 440/78 |

FOREIGN PATENT DOCUMENTS

| | | | |
|---|---|---|---|
| 21997 | 2/1981 | Japan | 440/49 |
| 213598 | 10/1985 | Japan | 440/81 |
| 2094894 | 9/1982 | United Kingdom | 440/81 |
| 2160618 | 12/1985 | United Kingdom | 440/81 |

*Primary Examiner*—Sherman D. Basinger
*Assistant Examiner*—Stephen P. Avila
*Attorney, Agent, or Firm*—Robert C. Curfiss

[57] ABSTRACT

A marine drive for a boat (3) includes a longitudianlly extending propeller shaft (17, 37, 38) which effectively carries the propeller hub (18, 41, 42) between a pair of fore and aft conical surfaces (26–29; 44–47; 51–54) which mate with similar conical surfaces associated with the hub. These mating surfaces prevent orbiting movement of the propeller. The mating surfaces also center the hub on its axis and provide for high torque retention. The construction is such that water is kept out of the joint between the hub and propeller shaft, with pre-applied lubricant being retained therein. The inventive concepts may be utilized with a single propeller system (FIG. 2), or dual propeller installation (FIG. 4).

7 Claims, 1 Drawing Sheet

MARINE DRIVE WITH IMPROVED PROPELLER MOUNTING

BACKGROUND AND SUMMARY OF THE INVENTION

This invention relates to marine drives, and more particularly to particularly to an improved propeller mounting for such drives in both outboard motor and stern drive applications.

Heretofore, it has been observed that the aft portions of some marine shafts have tended to fracture or break off adjacent the propeller hub. Furthermore, the splined aft sections of some marine propeller shafts have been subject to undesirable corrosion.

It has been determined by the inventor that the first problem has been caused by lack of concentricity in the propeller shaft mounting, while the second problem has been due to lack of sufficient sealing adjacent the splined shaft portion.

It is an object of the present invention to solve these problems in a unique manner, while more adequately securing the propeller shaft.

In accordance with the various aspects of the invention, a marine drive for a boat includes a longitudinally extending propeller shaft which effectively carries the propeller hub between a pair of fore and aft conical surfaces which mate with similar conical surfaces associated with the hub. These mating surfaces restrain orbiting movement of the propeller to essentially eliminate fracturing or breaking of the propeller shaft. The mating surfaces also center the hub on its axis and provide for high torque retention. The construction is such that corrosive water is kept out of the joint between the hub and propeller shaft, with pre-applied lubricant being retained therein.

The inventive concepts may be utilized with a single propeller system, or a dual propeller installation.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
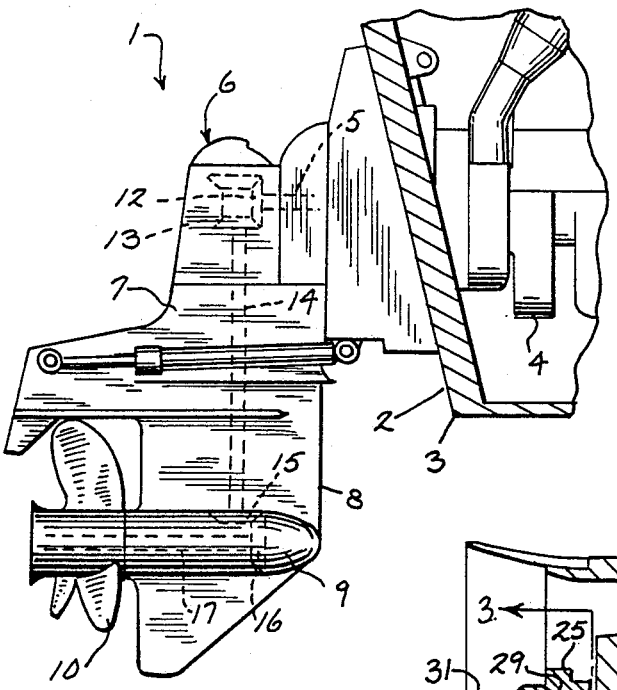
FIG. 1 is a generally schematic side elevation of a marine drive which incorporates various aspects of the invention.

FIG. 1 of the drawings illustrates the present invention as applied to a marine stern drive unit, although the inventive aspects are equally applicable to an outboard motor. As shown, stern drive unit 1 is adapted to be suitably mounted to the transom 2 of a boat 3. An internal combustion engine 4 is disposed within the boat and includes an output with a shaft 5 which extends through transom 2 to unit 1, in the usual manner.

Stern drive unit 1 generally includes stern drive housing 6 forming an upper gear case 7, a lower gear case 8 suitably mounted to gear case 7, and a generally horizontally fore-to-aft extending torpedo housing 9 forming a portion of and disposed at the bottom of gear case 8.

Figure 2:
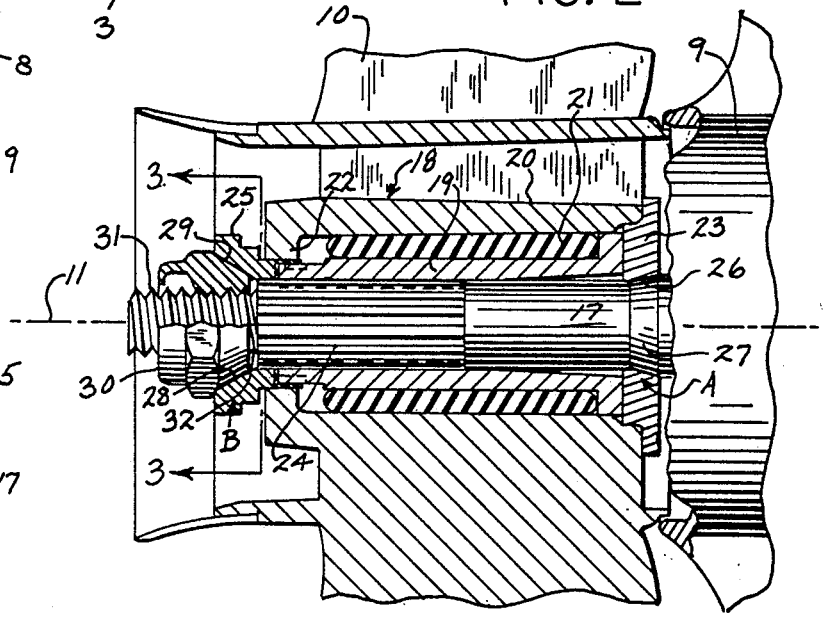
FIG. 2 is an enlarged fragmentary view of the propeller mounting of the drive of FIG. 1, and with parts broken away and in section.
Figure 3:
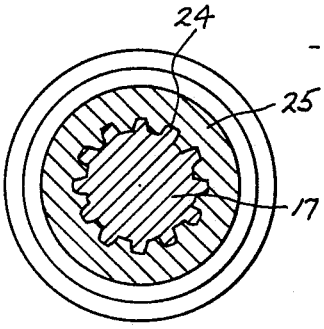
FIG. 3 is a transverse section taken on line 3—3 of FIG. 2.

As shown in FIGS. 1 and 2, a propeller 10 is mounted for rotation on a propeller drive axis 11 generally aft of housing 9. For purposes of driving propeller 10, a pinion 12 is disposed on the outer end of shaft 5 and meshes with a gear 13 mounted to the upper end of a vertical main drive shaft 14 within upper gear case 7. Main drive shaft 14 extends downwardly and through lower gear case 8, and is provided with a pinion 15 on its lower end. Pinion 15 meshes with a forwardly disposed rearwardly facing driving gear 16 mounted for rotation about axis 11. Driving gear 16 forms the forward end portion of a longitudinally extending propeller shaft 17 which is mounted for rotation in torpedo housing 9, and which mounts propeller 10 on its rearward end.

Propeller 10 is provided with a central hub assembly 18 which is shown as including an inner cylindrical hub portion 19 and an outer cylindrical hub portion 20 with a rubber shock hub 21 therebetween. The rearward end of outer hub portion 20 is flanged radially inwardly, as at 22, while a hub closure plate 23 is suitably affixed to the forward end of hub assembly 18. Propeller shaft 17 extends rearwardly through plate 23 and flange 22. The adjacent surfaces of inner hub portion 19 and propeller shaft 17 are matingly splined, as at 24, along the rearward end portion of shaft 17. This splined area is normally provided with grease or other lubricant.

Furthermore, inner hub portion 19 is provided with a rearwardly extending effective extension beyond flange 22. In the present embodiment the extension comprises an annular washer 25 which is also splined to propeller shaft 17 and which has an enlarged diameter outwardly of flange 22.

In accordance with the various aspects of the invention, propeller shaft 17 effectively carries propeller hub assembly 18 between fore and aft conical surfaces which mate with similar conical surfaces associated with assembly 18. For this purpose, a forwardly facing conically-surfaced annular opening 26 is disposed in plate 23 at the front of assembly 18, and mates with a rearwardly facing annular conical surface 27 on shaft 17 to form a set A. Likewise, a rearwardly facing annular conical surface 28 is disposed at the rear end of hub portion 19, in washer 25, and thus at the rear of assembly 18. Surface 28 mates with a forwardly facing annular conical surface 29 formed in an adjustable nut 30 which is threaded onto propeller shaft 17, as at 31. This forms a set B facing oppositely from set A. When nut 30 is tightened onto washer 25, the tolerances are such that a small space 32 may be disposed between splined area 24 and the nut.

When propeller assembly 18 is placed onto the splined end of propeller shaft 17 and nut 30 tightened onto the shaft, the spaced fore and aft pairs of mating conical surfaces at both hub ends have a piloting effect which prevents orbiting of propeller 10 during shaft rotation to essentially eliminate fractures and breaks in shaft 17 adjacent set A. The mating surfaces also locate and center hub assembly 18 relative to axis 11. Furthermore, the mating conical surfaces provide increased friction and thus increased torque retention to more firmly hold propeller assembly 18 onto shaft 17. In addition, the construction is such that ambient water is excluded from and lubricant is retained in the splined area 24 and in space 32, the forward face of nut 30 serving to block fluid ingress and egress to and from the splined area. Corrosion problems are thus essentially eliminated.

Figure 4:
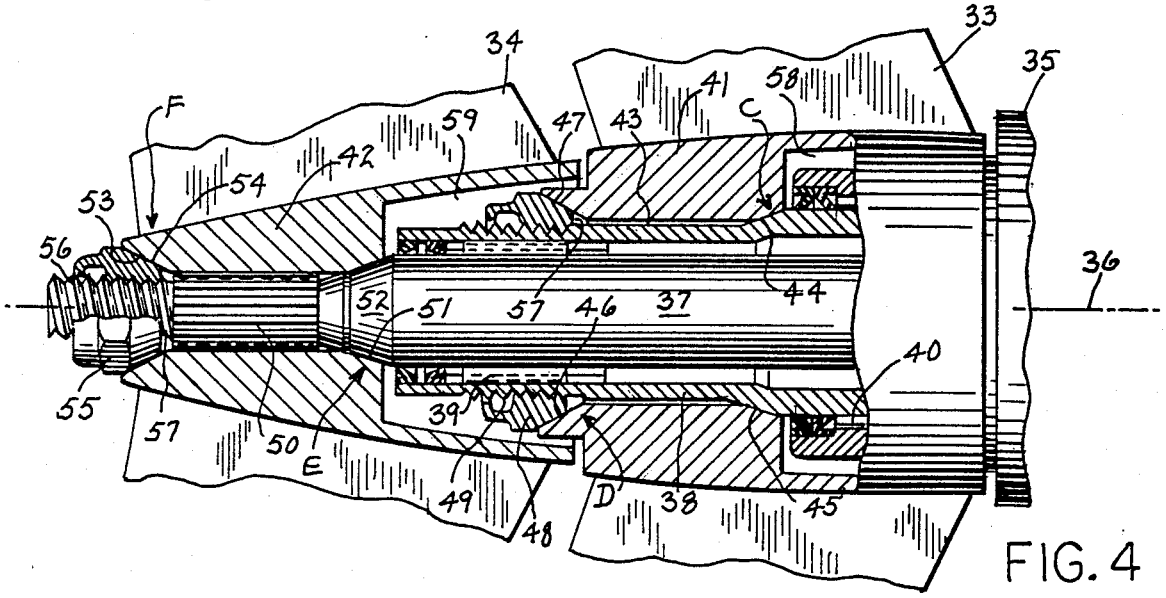
FIG. 4 is a view similar to FIG. 2 of another embodiment.

FIG. 4 illustrates another embodiment, wherein dual contra-rotating fore-and-aft propellers 33 and 34 respectively, are utilized. The motive means and general connecting drive for these propellers are not shown, but may be of any suitable well-known type. Suffice it to say that propellers 33 and 34 are disposed at the rearward end of a suitable torpedo housing 35 and are adapted to rotate about a common drive axis 36. Also, in this embodiment, a central propeller shaft 37 drives aft propeller 34, while a tubular propeller shaft 38 which is concentric with central shaft 37 drives front propeller 33. Furthermore, shafts 37 and 38 are journalled in suitable bearings 39 and 40.

In the present embodiment, forward propeller 33 is provided with a central hub 41, while rearward propeller 34 is provided with a central hub 42.

Referring first to the mounting of forward propeller 33, tubular propeller shaft 38 extends rearwardly through propeller hub 41 and the adjacent surfaces thereof are matingly splined, as at 43, slightly forwardly of the rear end of shaft 38. Propeller shaft 38 effectively carries hub 41 between fore and aft conical surfaces which mate with similar conical surfaces associated with hub 41. For this purpose, a forwardly facing and forwardly disposed conical surface 44 is disposed on hub 41, and mates with a rearwardly facing annular conical surface 45 on shaft 38 to form a set C. Likewise, a rearwardly facing undercut-type annular conical surface 46 is disposed on hub 41 and rearwardly of surface 44 to form a set D. Surface 46 mates with a forwardly facing annular conical surface 47 formed in an adjustable nut 48 which is threaded onto propeller shaft 38, as at 49.

Referring next to the mounting of rearward propeller 34, central propeller shaft 37 extends rearwardly through propeller hub 42 and the adjacent surfaces thereof are matingly splined, as at 50, adjacent the rear end of shaft 37. Propeller shaft 37 effectively carries hub 42 between fore and aft conical surfaces which mate with similar conical surfaces associated with hub 42. For this purpose, a forwardly facing and forwardly disposed conical surface 51 is disposed on hub 42, and mates with a rearwardly facing annular conical surface 52 on shaft 37 to form a set E. Likewise, a rearwardly facing undercut-type annular conical surface 53 is disposed on hub 42 and rearwardly of surface 51. Surface 53 mates with a forwardly facing annular conical surface 54 formed in an adjustable nut 55 which is threaded onto propeller shaft 37, as at 56. This forms a set F. When nut 55 is tightened onto shaft 37, the tolerances are such that a small space 57 may be disposed between splined area 50 and the nut.

The elimination of propeller orbiting, as well as the hub piloting, enhanced torque retention of the nuts, and the lubrication retention functions of each pair of the dual propeller mountings of FIG. 4 are similar to those of the single propeller mounting of FIG. 2, and need not be repeated.

In addition, the construction of FIG. 4 is such that bearings 39 and 40 are disposed in a more aft position and within forwardly facing recesses 58 and 59 disposed at the front end of hubs 41 and 42. Set D is disposed in recess 59. Reference is made to the prevent inventor's copending patent application. Ser. No. 07/197,452, entitled "Marine Drive With Improved Propeller Shaft Bearing Carrier Arrangement", filed on even date herewith.

Various modes of carrying out the invention are contemplated as being within the scope of the accompanying claims which particularly point out and distinctly claim the subject matter of the invention.

I claim:

1. In a marine drive, the combination comprising:
(a) a generally vertical drive housing (6) terminating in a lower torpedo housing (9, 35),
(b) a propeller shaft (17, 37, 38) disposed within and extending longitudinally rearwardly from said torpedo housing in a generally fore-to-aft direction, and with said shaft being rotatable on a longitudinal drive axis (11, 36),
(c) a propeller (10, 33, 34) disposed on the rearward portion of said shaft, and with said propeller having a hub (18, 41, 42),
(d) and means mounting said propeller to said shaft,
(e) said mounting means including a pair of longitudinally spaced fore and aft sets (A-B; C-D; E-F) of generally longitudinally facing mating conical surfaces disposed on said shaft and said hub, each set in said pair of sets facing oppositely from the other said set in said pair; said mating conical surfaces providing a piloting effect to prevent orbiting of said propeller (10) and a centering effect for said hub (18).

2. The combination of claim 1 wherein:
(a) one conical surface (29, 47, 54) in one of said pair of sets (B, D, F) forms part of an adjustable nut (30, 48, 55) threadably mounted to said shaft,
(b) and the other conical surface (28, 46, 53) of said one of said pair of sets is disposed on said hub.

3. The combination of claim 2 wherein: when said nut (30, 48, 55) is threadably adjusted onto said shaft to provide mating engagement between said one conical surface (29, 47, 54) and said other conical surface (28, 46, 53), said mating conical surfaces restraining said propeller against orbiting during rotation of the latter.

4. The combination of claim 2 wherein: when said nut (30, 48, 55) is threadably adjusted onto said shaft to provide mating engagement between said one conical surface (29, 47, 54) and said other conical surface (28, 46, 53), the friction between said mating one conical surface (29, 47, 54) and said other conical surface (28, 46, 53) provides enhanced torque retention for said nut.

5. The combination of claim 2 wherein:
(a) said shaft and said hub are splined together along a longitudinal area (24, 43, 50),
(b) lubricant is disposed in said area,
(c) and when said nut (30, 48, 55) is threadably adjusted onto said shaft to provide mating engagement between said one conical surface (29, 47, 54) and said other conical surface (28, 46, 53), said nut forms means to retain said lubricant in said splined area and to prevent ingress of ambient water into said area.

6. The combination of claim 1, 2, 3, 4 or 5 which includes dual propeller shafts (37, 38) mounting dual forwardly and rearwardly disposed propellers (33, 34).

7. The combination of claim 6:
(a) which includes a forwardly facing recess (59) disposed in the hub (42) of said rearwardly disposed porpeller (34),
(b) and wherein a set (D) of said conical surfaces disposed in association with said forwardly disposed propeller (33) is disposed within said recess.

* * * * *